US008168900B2

(12) United States Patent
Haendler et al.

(10) Patent No.: US 8,168,900 B2
(45) Date of Patent: May 1, 2012

(54) AUXILIARY OPERATING DEVICE FOR AN ELECTROMECHANICAL SWITCHING DEVICE

(75) Inventors: Kurt Haendler, Bonn (DE); Walter Gilgen, Koenigswinter (DE); Klaus-Dieter Nuerenberg, Koenigswinter (DE)

(73) Assignee: Eaton Industries GmbH, Bonn (DE)

( * ) Notice: Subject to any disclaimer, the term of this patent is extended or adjusted under 35 U.S.C. 154(b) by 662 days.

(21) Appl. No.: 12/328,586

(22) Filed: Dec. 4, 2008

(65) Prior Publication Data

US 2009/0139845 A1 Jun. 4, 2009

(30) Foreign Application Priority Data

Dec. 4, 2007 (DE) ..... 10 2007 058 489

(51) Int. Cl.
*H01R 31/08* (2006.01)
*H01H 13/62* (2006.01)

(52) U.S. Cl. ..... 200/43.05; 200/332; 200/566

(58) Field of Classification Search ..... 200/332, 200/330, 318, 321, 322, 43.01, 43.16–43.19, 200/43.21, 566, 334, 50.05, 50.06, 329, 331, 200/336, 43.05, 43.08
See application file for complete search history.

(56) References Cited

U.S. PATENT DOCUMENTS 3,009,029 A * 11/1961 Bodenschatz et al. ..... 200/50.15
6,797,903 B1 9/2004 Winslett et al.
6,989,499 B2 1/2006 Bortolloni et al.
7,071,427 B2 7/2006 Houck, III et al.
7,071,527 B2 7/2006 Iwabuchi et al.

FOREIGN PATENT DOCUMENTS

DE 4312428 11/1994
EP 1583120 10/2005

* cited by examiner

*Primary Examiner* — Felix O Figueroa
(74) *Attorney, Agent, or Firm* — Leydig, Voit & Mayer, Ltd.

(57) ABSTRACT

An auxiliary operating device for an electromechanical switching device having an operating mechanism. The auxiliary operating device including an actuating element couplable to the operating mechanism and movable between a first position and a second position, an actuation member movable relative to the actuating element between a third position and a fourth position, and a drive dog arrangement configured to cooperate with the actuating element and the actuation member. The auxiliary operating device further includes a coupling device movable between a release position and an operating position. The coupling device is configured, when in the operating position, so as to move the actuating element with the actuation member in a second direction of movement when the actuation member is in the third position. The coupling device is configured, when in the release position, so as to allow movement of the actuation member in the first and second directions between the third and fourth positions.

19 Claims, 4 Drawing Sheets

AUXILIARY OPERATING DEVICE FOR AN ELECTROMECHANICAL SWITCHING DEVICE

CROSS REFERENCE TO PRIOR APPLICATIONS

Priority is claimed to German Patent Application DE 10 2007 058 489.1, filed Dec. 4, 2007, the entire disclosure of which is incorporated by reference herein.

FIELD

The present invention relates to an auxiliary operating mechanism for an electromechanical switching device having an operating mechanism for turning the switching device on and off.

BACKGROUND

Such auxiliary operating mechanisms are used in control cabinets, the operating mechanism of the switching device being non-rotatably connected to an externally operable door coupling rotary handle when the control cabinet door is closed. Opening the control cabinet door breaks the non-rotatable connection between the operating mechanism and the door coupling rotary handle. Typically, auxiliary operating mechanisms are provided to allow the operating mechanism of the switching device to be actuated even when maintenance work is being carried out on the switching device.

To ensure that when the control cabinet door is open, the switching device can be turned on deliberately and be turned off as quickly as possible, U.S. Pat. No. 7,071,527 B2 describes an auxiliary operating mechanism which is connected to an electromechanical switching device mounted in a control cabinet and which is in engagement with an externally operable door coupling rotary handle when the control cabinet door is closed. When opening the control cabinet door, the auxiliary operating mechanism moves out of engagement with the door coupling rotary handle. The auxiliary operating mechanism has a handle housing which is formed with grip elements is and mounted about an actuating shaft in such a way that it is rotatable and axially displaceable to a limited extent. The actuating shaft is connected to the operating mechanism of the switching device and is movable into engagement with the door coupling rotary handle as the control cabinet door is closed. The handle housing contains therein a polygonal ratchet wheel which is mounted on the actuating shaft in such a way that it is rotatable and axially displaceable to a limited extent and which, in conjunction with axially extending first ribs formed on the inner wall of the handle housing, forms a unidirectional rotary coupling. This unidirectional rotary coupling has the effect that when a single rotational movement is imparted to the rotary handle in only one of the two directions of rotation, this rotational movement will be transmitted to the actuating shaft, whereas in the other case, no transfer of movement will take place. Thus, an effect will be produced only by the switch operating movement imparted via the handle housing in one direction, preferably in the direction for turning the switching device off. The handle housing further contains therein a coupling wheel which is non-rotatably mounted on the actuating shaft in such a way that it is axially displaceable to a limited extent and which has axially extending second ribs formed on its periphery A helical spring is braced between the coupling wheel and the ratched wheel and acts upon the coupling wheel relative to the handle housing in a direction away from the switching device, the coupling wheel abuting a ring-shaped housing part which is formed with grip elements and is screwed to the handle housing at one end. In this condition, the rotational movement of the handle housing can only be transmitted via the unidirectional rotary coupling. When the door coupling handle comes into engagement as the control cabinet door is closed, or when pulling on the handle housing when the control cabinet door is open, the coupling wheel is displaced axially relative to the handle housing against the force of the helical spring, thereby moving the second ribs of the coupling wheel in between the first ribs in the handle housing. In this condition, motion is transferred from the handle housing to the actuating shaft in both directions of rotation. This bidirectional motion transfer now allows for switch operating movements in both directions, i.e., both for turning the switching device off and for turning it on. This auxiliary operating mechanism has the disadvantage that it is expensive and complex to manufacture.

SUMMARY

It is an aspect of the present invention to provide an auxiliary operating mechanism which is simple in construction and prevents inadvertent transfer of a switch operating movement which would turn on the switching device.

In an embodiment, the present invention provides an auxiliary operating device for an electromechanical switching device having an operating mechanism. The auxiliary operating device includes an actuating element couplable to the operating mechanism and movable between a first position and a second position, an actuation member movable relative to the actuating element between a third position and a fourth position, and a drive dog arrangement configured to cooperate with the actuating element and the actuation member so as to move the actuating element with the actuation member in a first direction of movement when the actuation member is in the third position. The auxiliary operating device further includes a coupling device configured to cooperate with the actuation member and the actuating element, the coupling device being movable between a release position and an operating position. The coupling device is configured, when in the operating position, so as to move the actuating element with the actuation member in a second direction of movement when the actuation member is in the third position. The coupling device is configured, when in the release position, so as to allow movement of the actuation member in the first and second directions between the third and fourth positions.

BRIEF DESCRIPTION OF THE DRAWINGS

A preferred exemplary embodiment of an auxiliary operating mechanism according to the present invention is described in more detail below with reference to the drawings, in which.

DETAILED DESCRIPTION

Figure 1:
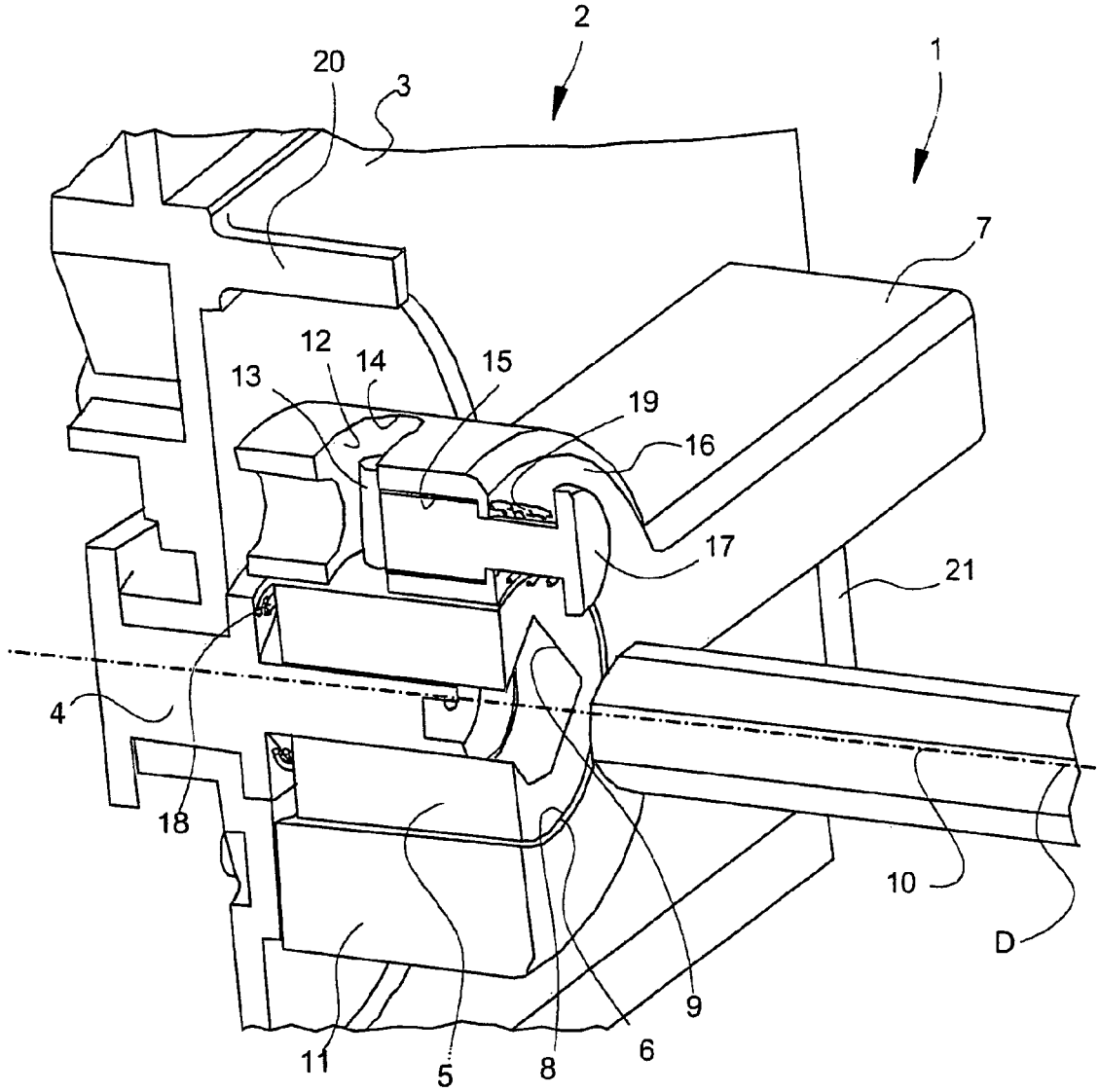
FIG. 1 shows a switching device having an auxiliary operating mechanism according to the present invention in a perspective view where the actuating element is in the ON position, the actuation member is in the first position, relative to the actuating element 5, and the position control member is in the release position.

An aspect of the present invention provides an auxiliary operating mechanism for an electromechanical switching device having an operating mechanism, the auxiliary operating mechanism including:

an actuating element which is connectable to, or forms part of, the operating mechanism of the switching device and is movable between an ON position and an OFF position, an actuation member which is movable relative to the actuating element between a first position and a second position, a drive dog arrangement which acts between the actuation member and the actuating element and which, when the actuation member is in the first position, causes the actuating element to be carried along in a first direction of movement of the actuation member, and coupling means which act between the actuation member and the actuating element and are movable between a release position and an operated position, said coupling means, after being moved to the operated position, at least when the actuation member is in the first position, causing the actuating element to be carried along in a second direction of movement, and when said coupling means are in the release position, they allow the actuation member to move freely in both directions of actuation between the first position and the second position.

Thus, when the coupling means are in the release position, the actuation member can be moved freely relative to the actuating element between the first position and the second position. Preferably, the actuating element is mounted such that it is rotatable about an axis of rotation between an ON position and an OFF position, the actuation member also being rotatably mounted about the axis of rotation. The term "actuating element", as used in the context of the present invention, refers either to an element of the operating mechanism of the switching device itself, or to a separate component which is connectable, for example, to an operating shaft of the operating mechanism, or may also refer to an actuating shaft between the operating mechanism and a door coupling rotary handle. Preferably, the actuating element is a separate component which is connectable, for example, to an operating shaft of the operating mechanism.

When the actuation member is in the first position relative to the actuating element, the drive dog arrangement causes the actuating element to be carried along when it is moved in a first direction of movement. Such movement in the first direction preferably turns the switching device off. In the opposite second direction, which preferably serves to turn the switching device on, the actuation member is freely rotatable, without causing the actuating element to be carried along.

The controllable coupling means are capable of enabling the actuating element to be carried along when the actuation member is moved in the second direction of rotation.

Thus, only deliberate actuation of the coupling means will enable torque transfer in the second direction of movement and, therefore, this deliberate action only allows turning on of the switching device.

Preferably, the actuation member has a central bore by which it is rotatably mounted on a shaft-like section of the actuating element, and preferably in such a manner that it is axially immovable relative to the actuating element. The drive dog arrangement may include an opening formed in the actuation member and extending over a portion of a circumference about the axis of rotation. In this case, the drive dog arrangement further includes a drive dog which is formed by, or connectable to, the actuating element and which extends into said opening with some circumferential play.

The opening is bounded in the circumferential direction by a stop surface, which is in contact with or in proximity to the drive dog when the actuation member is in the first position. This enables torque transfer in the first direction of movement.

The drive dog may be a pin secured to the actuating element.

Specifically, the drive dog may be threadedly received in a threaded hole. If the actuating element is a separate component which is attachable to the operating mechanism, then the actuating element usually has a mounting opening by which it is mounted on an operating shaft of the operating mechanism. In this case, the threaded hole may be oriented radially and extend to the mounting opening, the drive dog being used to secure the actuating element on the operating shaft.

Preferably, the opening opens into the central bore.

Furthermore, first spring means may be provided to act upon the actuation member so as to cause it to assume the first position. The spring forces of the first spring means are adapted to the switching device in such a manner that moving the actuation member against the force of the first spring means will not produce a switching operation and will not cause the actuating element to be carried along. The purpose of the first spring means is only to hold the actuation member always in the first position, or to move it from a different position to that position.

The first spring means may take the form of a torsion spring that bears against the actuation member at one end and against the actuating element at the other end.

Second spring means may be provided to act upon the coupling means so as to cause them to assume the release position, the coupling means preferably including a position control member.

The position control member is axially movably connected to the actuation member and engages in the opening when in the operated position.

Preferably, the coupling means are configured such that when the actuation member is in the first position and the coupling means are in the operated position, the actuation member is non-rotatably connected to the actuating element.

Moreover, provision may be made for a first limit stop to prevent the actuation member from being moved beyond a position relative to the switching device that corresponds to the OFF position of the actuating element. Moreover, provision may be made for a second limit stop to prevent the actuation member from being moved beyond a position relative to the switching device that corresponds to the ON position of the actuating element.

FIG. 1 is a perspective, longitudinal sectional view of the auxiliary operating mechanism 1 according to the present invention. Auxiliary operating mechanism 1 is provided on a switching device 2. Switching device 2 has a housing 3 from which projects an operating shaft 4 of an operating mechanism of switching device 2. To allow switching device 2 to be operated, operating shaft 4 is rotatable about an axis of rotation D between an ON position and an OFF position.

An actuating element 5 is mounted on operating shaft 4 coaxially with axis of rotation D is and non-rotatably connected to operating shaft 4. To enable non-rotatable connection of actuating element 5, the actuating element is provided with a central mounting opening 9 which extends through actuating element 5 along axis of rotation D. Mounting opening 9 has a cross-sectional shape different from that of a circle, and operating shaft 4 is configured accordingly so as to provide a non-rotatable connection between actuating element 5 and operating shaft 4. Thus, actuating element 5 and operating shaft 4 can be jointly rotated between the ON position and the OFF position.

The thickness of actuating element 5 in the direction of axis of rotation D is such that operating shaft 4 does not extend through the entire mounting opening 9, so that an actuating shaft 10 having a suitable cross-sectional shape can be non-rotatably inserted into mounting opening 9 from the side remote from housing 3. Actuating shaft 10 is used for connection to a door coupling rotary handle provided on a door of a control cabinet.

Actuating element 5 further has a cylindrical bearing surface 6 which extends coaxially with axis of rotation D and on which is rotatably mounted an actuation member 7. For this purpose, actuation member 7, which is in the form of a lever, features a sleeve-like bearing portion 11 having a central bearing bore 8 by which actuation member 7 sits on actuating element 5.

Bearing portion 11 has a slotted opening 12 formed therein which extends over a portion of the circumference of sleeve-like bearing portion 11. Opening 12 fully penetrates bearing portion 11 in a radial direction. However, it would, in principle, be sufficient to have an opening that originates at bearing bore 8 and does not extend through to the outer circumferential surface of bearing portion 11.

Located in opening 12 is a drive dog 13 which is non-rotatably connected to actuating element 5. Drive dog 13 is in the form of a pin threadedly received in a radially extending threaded hole 23 in actuating element 5. As can be seen in the following figures, threaded hole 23 extends radially from bearing surface 6 of actuating element 5 into mounting opening 9, so that drive dog 13 can be screwed through threaded hole 23 to secure actuating element 5 on operating shaft 4.

Opening 12 and drive dog 13 form part of a drive dog arrangement whose operation is described below. Opening 12 is bounded in the circumferential direction by a stop surface 14 at one end, said stop surface being in contact with or in proximity to drive dog 13 when actuation member 7 is in the position shown in FIG. 1. In FIG. 1, actuation member 7 is in a first position relative to actuating element 5, and actuating element 5 is in an ON position. In this position, actuation member 7 can be rotated counterclockwise (looking at housing 3 in the direction of axis or rotation D). In the process, stop surface 14 acts upon drive dog 13, thus ensuring that actuating element 5 is carried along. Thus, actuation member 7 and actuating element 5 move together. Rotation of actuation member 7 in a clockwise direction with respect to actuating element 5 is always possible because, in that case, drive dog 13 can be moved freely within opening 12 without being carried along by stop surface 14.

Bearing portion 11 further has a hole 15 formed therein, said hole extending parallel to axis of rotation D and leading from an end face 16 of bearing portion 11 into opening 12. A position control member 17 in the form of a pushbutton is displaceably located in hole 15. Position control member 17 can be moved between a release position (shown in FIG. 1) and a pushed-in, operated position. When position control member 17 is in the operated position, it extends into opening 12 such that when actuation member 7 is in the position shown in FIG. 1, it will be located next to drive dog 13 in a manner allowing said drive dog to bear against position control member 17 in a circumferential direction. In that condition, drive dog 13 is located between stop surface 14 and position control member 17, which ensures that drive dog 13, and thus actuating element 5, can be carried along in both directions of rotation. Therefore, position control member 17 represents coupling means acting between actuation member 7 and actuating element 5. In this connection, it is possible to conceive of an arrangement where no play is provided between actuation member 7 and actuating element 5 in the circumferential direction; however, the coupling arrangement may also have some play.

First spring means 18 are provided to act between actuating element 5 and actuation member 7, said first spring means being in the form of a torsion spring that bears against actuating element 5 at one end and against actuation member 7 at the other end. First spring means 18 act upon actuation member 7 in a direction to move it to the first position, the spring forces of first spring means 18 being such that moving actuation member 7 against the force of first spring means 18 will not cause actuating element 5 to be moved. The intention is only to reliably hold actuation member 7 in the first position, or move it to this position.

Also provided are second spring means 19 to act axially upon position control member 17 so as to cause it to assume the release position, so that position control member 17 will automatically return to the release position after it has been actuated.

Moreover, a first limit stop 20 is provided on housing 3 to prevent actuation member 7 from being moved counterclockwise beyond a position relative to the housing 3 that corresponds to the OFF position of actuating element 5. Furthermore, a second limit stop 21 is provided to prevent actuation member 7 from being moved clockwise beyond a position relative to the housing 3 that corresponds to the ON position of actuating element 5. However, the auxiliary operating mechanism can in principle also be operated without limit stops 20, 21.

Figure 3:
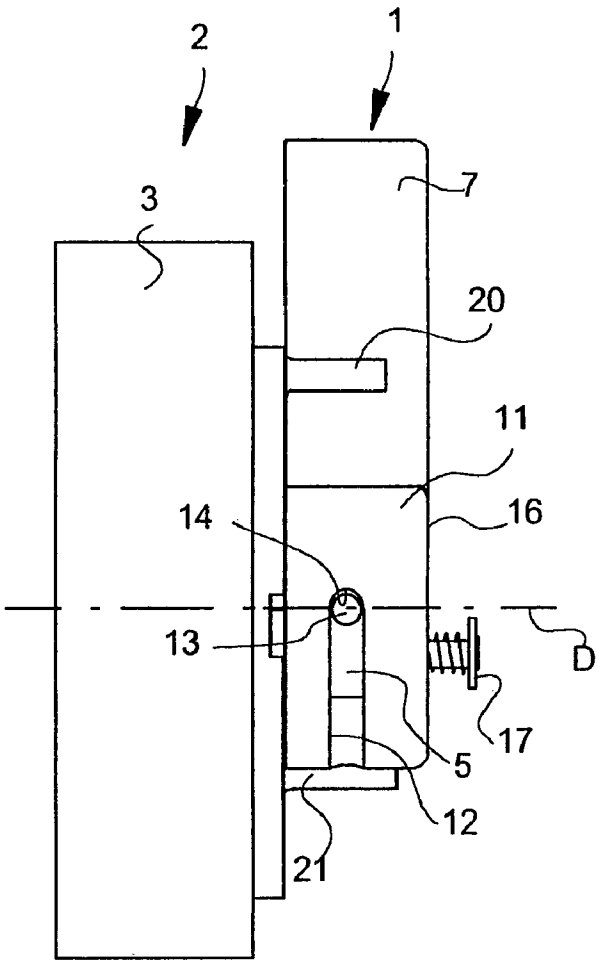
FIG. 3 shows the switching device of FIG. 2 in a side view.
Figure 2:
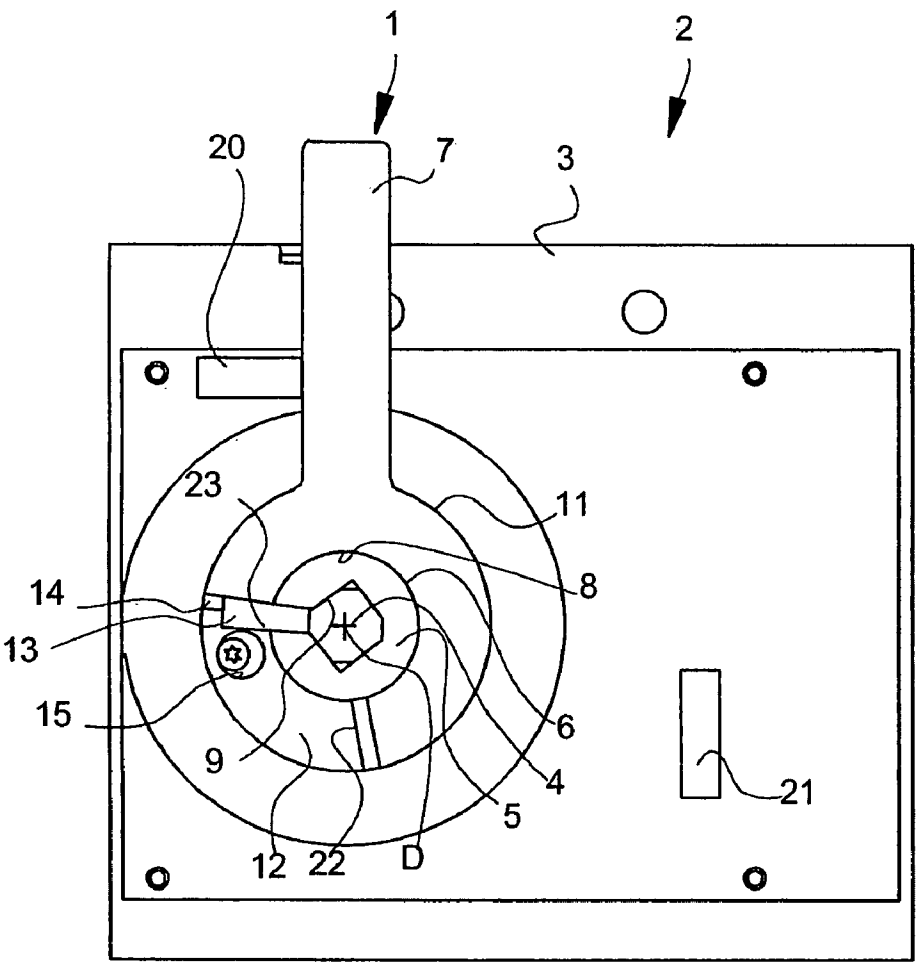
FIG. 2 shows the switching device of FIG. 1 in an elevation view where the actuating element is in the OFF position, the actuation member is in the first position, relative to the actuating element 5, and the position control member is in the release position.

FIGS. 2 and 3 show switching device 2 and auxiliary operating mechanism 1 in different views showing actuating element 5 in the OFF position and actuation member 7 in the first position relative to actuating element 5. Position control member 17 is in the release position, so that actuation member 7 can be moved freely between the first position (shown) and the second position without rotating actuating element 5.

In the position shown in FIG. 2, the position control member is in its release position. At the peripheral end of the opening 12 remote from stop surface 14, said opening is bounded by a contact surface 22. When moving actuation member 7 to the second position, contact surface 22 comes into contact with position control member 17.

In the position shown, actuation member 7 is in contact with the first limit stop, which prevents actuation member 7 from being rotated beyond the position corresponding to the OFF position of actuating element 5. To avoid redundancy, it is perfectly possible that only actuation member 7 may be in contact with limit stop 20 or, alternatively, that only drive dog 13 may be in contact with stop surface 14, while the respective other components have a small clearance therebetween.

Figure 5:
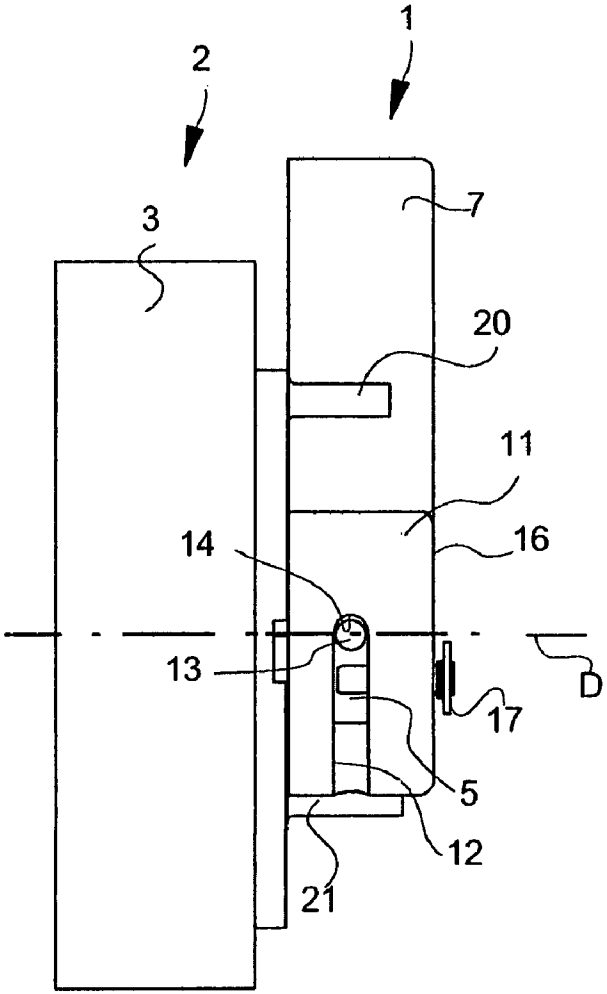
FIG. 5 shows the switching device of FIG. 4 in a side view.
Figure 4:
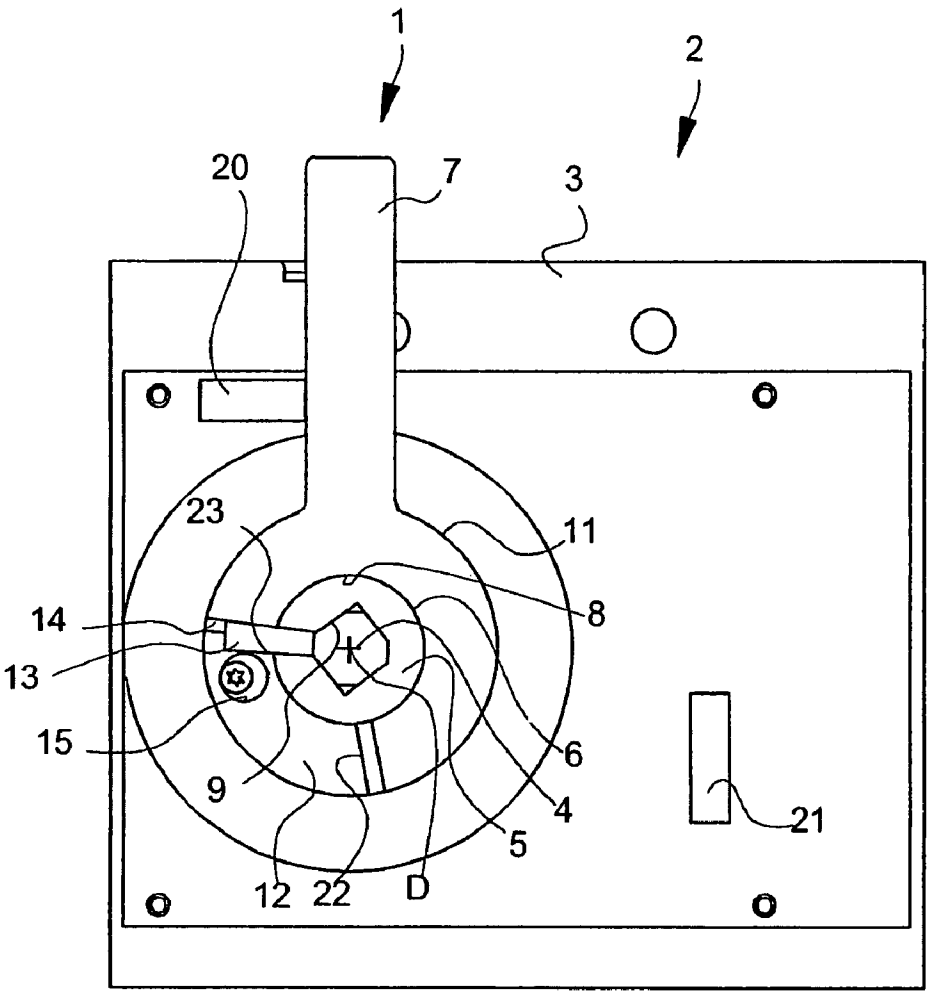
FIG. 4 shows the switching device of FIG. 1 in an elevation view where the actuating element is in the OFF position, the actuation member is in the first position, relative to the actuating element 5, and the position control member is in the operated position.
Figure 7:
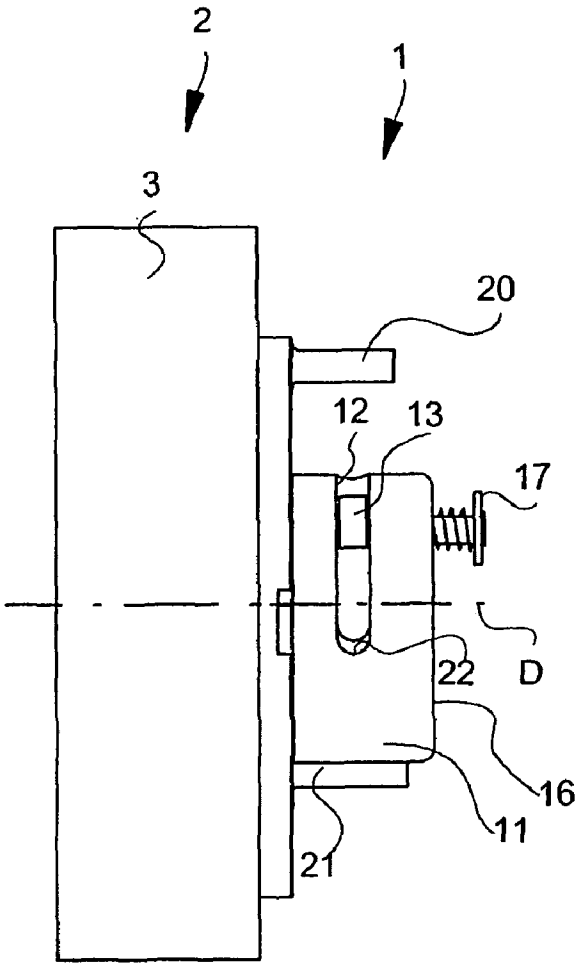
FIG. 7 shows the switching device of FIG. 6 in a side view.
Figure 6:
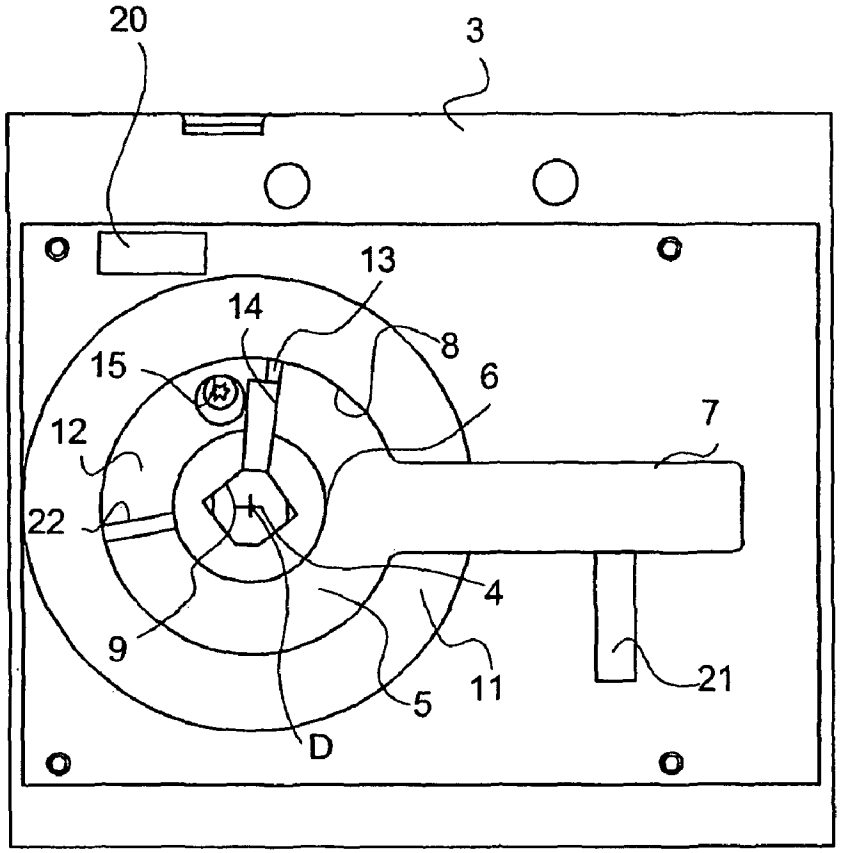
FIG. 6 shows the switching device of FIG. 1 in an elevation view where the actuating element is in the ON position, the actuation member is in the first position, relative to the actuating element 5, and the position control member is in the release position.

In order to enable actuating element 5 to be moved to the ON position when the positions are as shown in FIG. 2, position control member 17 is moved to the operated position against the force of second spring means 19 as illustrated in FIGS. 4 and 5. In the operated position, position control member 17 extends into opening 12. Then, as illustrated in FIG. 4, drive dog 13 is located without or with little play between stop surface 14 and position control member 17, thus providing a non-rotatable connection between actuation member 7 and actuating element 5. Rotation of actuation member 7 in a clockwise direction (second direction of movement) in accordance with FIGS. 6 and 7 will then also move the actuating element in a clockwise direction from the OFF position to the ON position.

In positions other than the first, position control member 17 can either not be moved to the operated position because it abuts axially against drive dog 13, or it can be moved to operated position, but is then located between drive dog 13 and contact surface 14, so that rotation in a clockwise direction will not cause actuating element 5 to be carried along. The position control member 17 may, in principle, also take a different form. For example, provision could be made for a kind of a jaw coupling or a longitudinally toothed releasable connection providing a non-rotatable connection in all positions of actuation member 7 relative to actuating element 5.

When actuating element 5 is in the ON position, actuation member 7 is in the first position, relative to the actuating element 5, and is in contact with second limit stop 21. Moreover, drive dog 13 is in contact with stop surface 14. As described in connection with first limit stop 20, only actuation member 7 is in contact with second limit stop 21 or, alternatively, only drive dog 13 is in contact with stop surface 14, while the respective other components have a small clearance therebetween.

When actuation member 7 is rotated in a counterclockwise direction (first direction of movement) to a position corresponding to the OFF position of actuating element 5, drive dog 13 is in contact with, or is moved into contact with, the stop surface, which ensures that actuating element 5 can be carried along even when position control member 17 is in the release position. Therefore, it is not necessary to operate position control member 17 in order to turn off the switching device.

The present invention is not limited to the embodiments described herein; reference should be had to the appended claims.

What is claimed is:

1. An auxiliary operating device for an electromechanical switching device having an operating mechanism, the auxiliary operating device comprising:

an actuating element couplable to the operating mechanism and movable between a first position and a second position;

an actuation member movable relative to the actuating element between a third position and a fourth position;

a drive dog arrangement configured to cooperate with the actuating element and the actuation member so as to move the actuating element with the actuation member in a first direction of movement when the actuation member is in the third position; and a coupling device configured to cooperate with the actuation member and the actuating element, the coupling device being movable between a release position and an operating position, the coupling device being configured, when in the operating position, so as to move the actuating element with the actuation member in a second direction of movement when the actuation member is in the third position, and the coupling device being configured, when in the release position, so as to allow movement of the actuation member in the first and second directions between the third and fourth positions.

2. The auxiliary operating device as recited in claim 1, wherein the actuating element and the actuation member are rotatably coupled about a common axis of rotation.

3. The auxiliary operating device as recited in claim 2, wherein the actuation member includes a central bearing bore configured to rotatably couple the actuation member to the actuating element.

4. The auxiliary operating device as recited in claim 2, wherein the actuation member is axially fixedly coupled to the actuating element.

5. The auxiliary operating device as recited in claim 2, wherein the drive dog arrangement includes:

an opening disposed in a portion of the actuation member extending circumferentially about the common axis of rotation; and a drive dog coupled to the actuating element having at least some circumferential play and extending into the opening.

6. The auxiliary operating device as recited in claim 5, wherein the opening includes a stop surface bounding the opening in a circumferential direction and configured to contact the drive dog when the actuation member is in the third position.

7. The auxiliary operating device as recited in claim 5, wherein the drive dog includes a pin coupled to the actuating element.

8. The auxiliary operating device as recited in claim 5, wherein the actuating element includes a threaded hole configured to threadedly engage the drive dog.

9. The auxiliary operating device as recited in claim 8, wherein the actuating element is disposed on an operating shaft via a central axial mounting opening and the threaded hole extends radially to the central axial mounting opening so that that drive dog secures the actuating element to the operating shaft.

10. The auxiliary operating device as recited in claim 5, wherein the opening extends to a central bearing bore of the actuation member, the central bearing bore being configured to rotatably couple the actuation member to the actuating element.

11. The auxiliary operating device as recited in claim 1, further comprising a first spring device configured to bias the actuation member towards the third position.

12. The auxiliary operating device as recited in claim 11, wherein the first spring device includes a torsion spring disposed between the actuation member and the actuating element.

13. The auxiliary operating device as recited in claim 1, further comprising a spring device configured to bias the coupling device towards the release position.

14. The auxiliary operating device as recited in claim 5, wherein the coupling device includes a position control member.

15. The auxiliary operating device as recited in claim 14, wherein the position control member is axially movably coupled to the actuation member and extends, in the operating position of the coupling device, into the opening.

16. The auxiliary operating device as recited in claim 1, wherein, in the operating position of the coupling device and the third position of the actuation member, the actuation member is non-rotatably coupled to the actuating element.

17. The auxiliary operating device as recited in claim 1, further comprising a first limit stop configured to prevent a movement of the actuation member relative to the switching device beyond a position corresponding to the second position of the actuating element.

18. The auxiliary operating device as recited in claim 1, further comprising a second limit stop configured to prevent a movement of the actuation member relative to the switching device beyond a position corresponding to the first position of the actuating element.

19. The auxiliary operating device as recited in claim 1, wherein the first position is an ON position, and the second position is an OFF position.

* * * * *